United States Patent [19]

Fenley

[11] Patent Number: 5,070,558

[45] Date of Patent: Dec. 10, 1991

[54] DECORATIVE PILLOW

[76] Inventor: Joel Fenley, 362 Starling, Union Lake, Mich. 48037

[21] Appl. No.: 594,008

[22] Filed: Oct. 9, 1990

[51] Int. Cl.[5] ..... A47G 9/00

[52] U.S. Cl. ..... 5/434; 5/437; 5/490

[58] Field of Search ..... 5/434, 437, 441, 442, 5/490–493; D6/601

[56] References Cited

U.S. PATENT DOCUMENTS

| | | | |
|---|---|---|---|
| D. 257,200 | 10/1980 | LaRocca | D6/201 |
| 3,174,163 | 3/1965 | Gibson | 5/437 |
| 3,346,892 | 10/1967 | Du Priest | 5/434 X |
| 4,649,582 | 3/1987 | Cho | 5/434 |
| 4,670,924 | 6/1987 | Spector | 5/434 |
| 4,675,930 | 6/1987 | Sargent | 5/458 |
| 4,763,369 | 8/1988 | Spector | 5/434 |
| 4,873,736 | 10/1989 | Sapp et al. | 5/434 |
| 4,959,879 | 10/1990 | Marxhausen | 5/434 |

*Primary Examiner*—Michael F. Trettel
*Attorney, Agent, or Firm*—Krass & Young

[57] ABSTRACT

A contoured decorative pillow of resiliently deformable material. A pillow form is girded by at least one cincture and thus transformed from a first configuration into a second configuration. The decorative qualities of the second configuration may be further enhanced by encasing the cincture in an inelastic casing to create a ruffle or floral effect, girding the pillow form with a cushioned belt, employing one or two pillow covers, threading at least one ornamental body over the cincture or the cushioned belt, or fastening decorative means such as tassles to the cincture. The inelastic casing, cushioned belt, pillow covers, ornamental bodies, and cincture decorative means may be combined in an infinite number of decorative embodiments to suit the tastes of the pillow owner.

23 Claims, 1 Drawing Sheet

DECORATIVE PILLOW

BACKGROUND OF THE INVENTION

1. Field of the Invention

This invention relates generally to the field of pillows and more particularly to a resiliently deformable pillow form that may be girded by a cincture and thus transformed from a first configuration to a second configuration that is decorative and aesthetically-pleasing.

2. Description of the Relevant Prior Art

It is known to use pillows for decorative purposes to embellish the interior design of a room. Moreover, it is also known to construct a decorative pillow whose appearance may be altered to suit the mood of the owner. A representative example of the prior art is shown in U.S. Pat. No. 4,873,736 which describes a pillow structure having a plurality of panels which can be manipulated to alter the appearance of the pillow. However, despite the manipulation of the panels, the underlying geometrical shape of the pillow structure shown in the '736 patent is not changed.

The prior art also teaches pillow-like structures which undergo functional transformations. For example, U.S. Pat. No. 4,670,924 shows the use of drawstrings to constrict portions of a pillow to correspond with the head and lower body of an animal-figure design on a pillow cover. However, the drawstrings are functional, not decorative and only permit the user to change the pillow into an animal-like figure by constricting the neck and the waist. Likewise, U.S. Pat. No. Des.257,200 teaches a travelling pillow having a long, cylinderical shape with a tensioning means which may be wrapped around the middle portion of the pillow. In this case, neither the tensioning means nor the pillow is decorative: they are both functional.

Thus, it would be desireable to provide a pillow which may be altered by the user to assume a variety of decorative configurations.

SUMMARY OF THE INVENTION

Disclosed and claimed herein is a decorative pillow. A portion of a resiliently deformable pillow form is girded by a cincture, thus transforming the pillow form from a first configuration to a desired decorative second configuration.

The cincture used to gird the pillow form has a head located at one end and a corresponding loop located at the opposing end of the cincture. When the loop is positioned over the head, the cincture is in its closed position. The length of the cincture is such that when the cincture is in its closed position, it fits snugly around the designated portion of the pillow form. The head of the cincture may have decorative means attached to it to further enhance the aesthetically-pleasing qualities of the second configuration. In addition, more than one cincture may be used to modify the pillow form into the desired second configuration.

The pillow form may be completely enclosed in a first pillow cover. Optionally, a second pillow cover having either the same or different appearance as the first pillow cover may enclose a portion of the pillow form. To prevent the second pillow cover from coming off the pillow form, the loose edge of the second pillow cover may be tucked under or over the cincture when the cincture is girding the pillow form. The color or appearance of the cincture may complement or contrast the color or appearance of either pillow cover.

In another embodiment of the present invention, the cincture may be enclosed in an inelastic casing. The inelastic casing may have a length either equal to, greater than, or less than the length of the cincture. The greater length of the inelastic casing enables the casing to fold and pleat on itself along the entire length of the cincture when the cincture is in its closed position about the pillow form, thus creating a ruffle effect. If the ruffle is intended to conceal only a portion of the cincture, it is not necessary that the inelastic casing be longer than the cincture. The inelastic casing may also be bunched around the cincture to create a flower effect, twisted around the cincture to create a cable-like vine effect, or alternately bunched and twisted around the cincture to create a flower and vine effect. In addition, the cincture may be threaded through at least one ornamental body having an aperture therethrough so that when the cincture girds the pillow form the ornamental body is held snugly against the pillow form.

In yet another embodiment, the decorative pillow further includes a cushioned belt having flat, uncushioned ends. The cushioned belt girds the pillow form after the cincture has been positioned and is held in place by tucking the flat uncushioned ends under the cincture. Ornamental bodies having apertures may also be threaded over the cushioned belt.

The first pillow cover, the second pillow cover, the decorative means on the cincture head, the inelastic casing, the cushioned belt, and the ornamental bodies may be used in any combination to enhance the aesthetically-pleasing qualities of the decorative pillow of the present invention. Thus, an endless variety of unique, decorative effects may enhance the pillow of the present invention by utilizing various combinations of the aforementioned features.

DETAILED DESCRIPTION OF THE DRAWINGS

Figure 1:
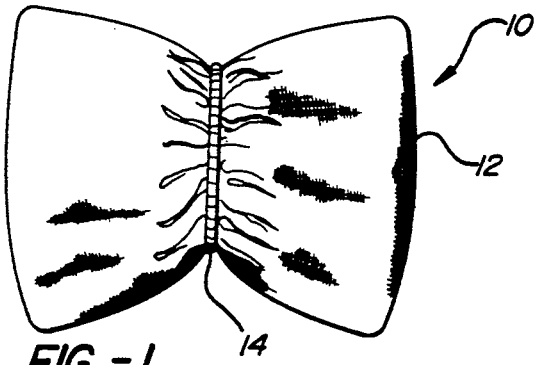
FIG. 1 is a perspective view of a decorative pillow constructed in accord with the teachings of the present invention.
Figure 2:
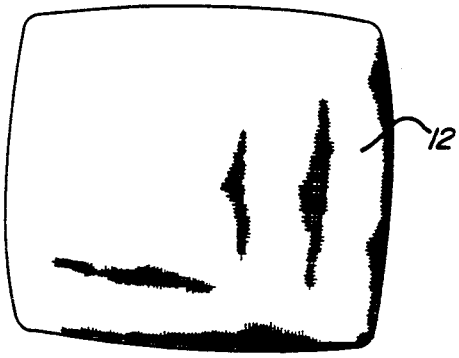
FIG. 2 is a perspective view of a pillow form used to create the decorative pillow of FIG. 1.
Figure 3:
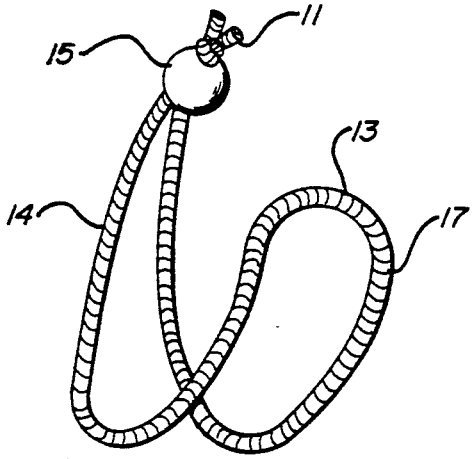
FIG. 3 is a perspective view of the cincture.

Referring now to the drawings and, in particular, to FIGS. 1, 2 and 3, there is depicted a decorative pillow 10 which includes a pillow form 12 girded by a cincture 14, thus transforming the pillow form 12 from an ungirded first configuration, as illustrated in FIG. 2, into one of an infinite number of girded second configurations. The pillow form 12 is resiliently deformable from the first configuration shown in FIG. 2 to a second configuration, such as that shown in FIG. 1. Although shown as a square, the pillow form 12 may be in the shape of a rectangle, a circle, a cylinder, or any other desired shape. The pillow form 12 may be filled with a wide variety of materials such as polyester stuffing, feathers, down, sponge foam, or other flexible fillers.

Figure 5:
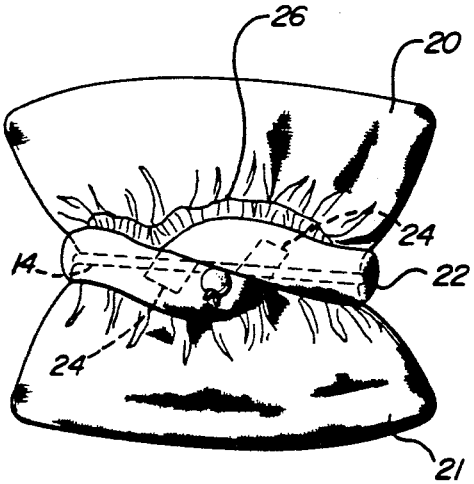
FIG. 5 is a perspective view of another embodiment of the present invention.

The pillow form 12 may optionally be completely enclosed in a first pillow case 20, shown in FIG. 5.

In FIG. 1, cincture 14 is shown wrapped around the middle of pillow form 12, thus transforming pillow form 12 into a second configuration having a butterfly shape. To create alternative embodiments, the cincture 14 may be wrapped around any portion of the pillow form 1 2, not just the middle portion, to produce a wide variety of second configurations. For example, the cincture 14 could gird the pillow form 12 diagonally, or it could be offset from the middle. The shape of the pillow form 12 and the positioning of the cincture 14 work in conjunction to create a variety of second configuration shapes. For example, a square pillow form 12 that is girded by a cincture 14 that is oriented near the top of the pillow form 12 creates the shape of a satchel or sack. Similarly, a second configuration resembling the shape of lips can be created by girding an oblong pillow form 12 in the middle with a cincture 14, as shown in FIG. 4.

Referring now to FIG. 3, the cincture 14 comprises a head 15 oriented near a first end 11 of the cincture 14 and a loop 17 adapted to receive said head 15 located at a second end 13 of the cincture 14. The cincture 14 is used to transform the pillow form 12 from the first configuration into one of an infinite number of second configurations by encircling a portion of the pillow form 12 with the cincture 14 and securing the cincture 14 in place by inserting the head 15 into the loop 17 to form a closed position. The cincture 14 must be of sufficient length from the first end 11 to the second end 13 so that when the head 15 is inserted in the loop 17 and the cincture 14 is in its closed position, the cincture 14 will snugly remain in position to maintain the shape of the pillow form 12 in the second configuration. To facilitate this snug positioning, the length of the cincture 14 in its closed position must be less than the perimeter of the portion of the pillow form 12 that is to be girded. The cincture 14 may come in a variety of forms. For example, the body of cincture 14 may be a large loop 17, as shown in FIG. 3. In an alternative embodiment of the cincture 14, the body of cincture 14 may comprise a single strand with a loop 17 oriented near the second end 13, said loop 17 being only slightly larger in circumference than the head 15 oriented near the first end 11. Preferably, the loop 17 is formed from an elastic material such as latex rubber, elastomeric polymers, or braided elastomers. The body of cincture 14 may be constructed from non-elastic materials such as rope, leather strips, braided fabric, or metallic chains as well as the aforementioned elastic materials so long as the length of the non-elastic cincture 14 in its closed position enables it to snugly maintain the shape of the second decorative configuration.

Figure 4:
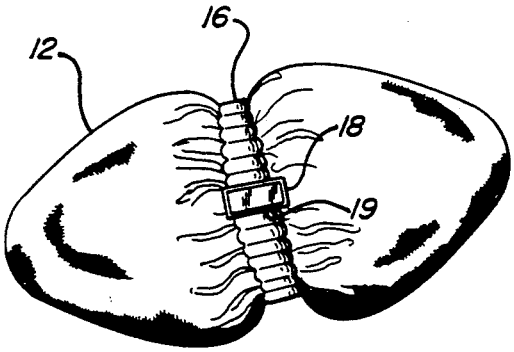
FIG. 4 is a perspective view of an alternate embodiment of the decorative pillow of the present invention.

In an alternative embodiment of the decorative pillow 10 shown in FIG. 4, the cincture 14 is encased in an inelastic casing 16. The inelastic casing 16 may be longer than the cincture 14 so as to allow the inelastic casing 16 to fold and pleat along the entire length of the cincture 14 to give the appearance of a ruffle surrounding the pillow form 12 when the cincture 14 is in its closed position. Twisting and/or bunching of the inelastic casing 16 around at least a portion of the cincture 14 may be implemented to create a flower and vine effect surrounding the pillow form 12, or any other decorative motiff, as desired. The inelastic casing 16 may also have a length either shorter than or equal to the length of the cincture 14 if it is not desired from a decorative standpoint to completely conceal the cincture 14. In addition, while the cincture 14 is encased in the inelastic casing 16, at least one ornamental body 18, such as a ring or buckle, having an aperture 19 formed therethrough may be threaded over the inelastic casing 16 to further enhance the appearance of the decorative pillow 10 when the cincture 14 girds the pillow form 12. The ornamental body 18 may also be threaded over the cincture 14 without the inelastic casing.

Another alternative embodiment of the present invention is illustrated in FIG. 5. In this embodiment, the first pillow case 20 encases the entire pillow form 12 and a second pillow case 21 having a different color, design, texture, pattern or otherwise disparate aesthetic appearance from the first pillow case 20 encases a portion of the pillow form 12. The second pillow case 21 may also be constructed of material identical to the material of the first pillow case 20. The cincture 14, shown in phantom, is oriented over a free edge 26 of the second pillow case 21 so as to hold the second pillow case 21 in place. Alternatively, the free edge 26 of the second pillow case may be tucked over and under the cincture 14 to secure the second pillow case 21 in position on the pillow form 12 while simultaneously concealing the cincture 14. In addition, a cushioned belt 22 of sufficient length to enable it to gird the pillow form 12 at least once and having two flat uncushioned ends 24 may be girded about the pillow form 12 and held in position by tucking at least one of the flat uncushioned ends 24 beneath the cincture 14. Optionally, at least one ornamental body 18 may also be threaded over the cushioned belt 22.

Figure 6:
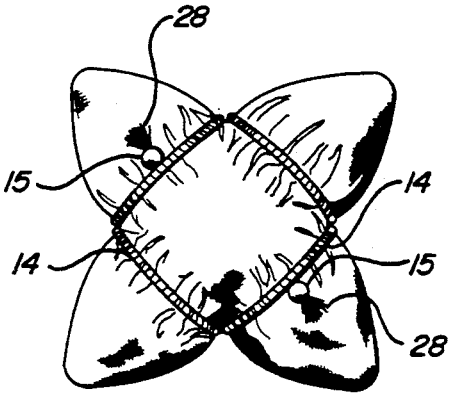
FIG. 6 is a perspective view of another embodiment of the present invention employing two cinctures.

Yet another alternative embodiment of the present invention is shown in FIG. 6. In this embodiment, two cinctures 14 are employed to shape the pillow form 12 into a desired second configuration. A plurality of cinctures 14 may be girded about any given pillow form 12 to create a desired second configuration. For example, the shape of a four-petal flower can be created by girding a square pillow form 12 in the middle with two cinctures 14 that intersect each other at right angles. In addition, decorative means 28, such as a tassel, bow, or bead, may be attached to the head 15 of each cincture 14 to further enhance the appearance of the pillow form 12. For other alternative embodiments, the cushioned belt 22, the inelastic casing 16, the ornamental body 18, the decorative means 28, the number of cinctures 14, and the second pillow case 21 may be used in any combination to enhance the appearance of the decorative pillow 10 as desired.

Having thus described my invention, it can be seen that numerous alternative configurations can be envisioned by one skilled in the art by utilizing the teachings of this invention. It is the claims and all equivalents thereof, not the embodiments and exemplifications described herein, which define the true scope of the invention. I therefore claim:

I claim:

1. A decorative pillow comprising:

a pillow form resiliently deformable from a first configuration to a second decorative configuration; and a cincture for girding said pillow having a head disposed proximate a first end and a loop constructed from elastic materials adapted to receive said head formed proximate a second end, said cincture having a length such that, when said cincture is wrapped around at least a portion of said form in its first configuration and said first and second ends of the cincture are joined together by engagement of said loop with said head, said form is modified to the second decorative configuration.

2. The pillow of claim 1 further comprising a first pillow cover configured to cover and contain said pillow form.

3. The pillow of claim 1 further comprising a cushioned belt having a length sufficient to encircle said pillow form when it is in its second configuration, said belt having flat, uncushioned end portions adapted to be tucked under said cincture to secure said belt around said pillow form.

4. The pillow of claim 3 further comprising an ornamental body having an aperture therethrough such that the cushioned belt may be threaded through the aperture, thereby securing the ornamental body to the pillow form when the belt is secured therearound.

5. The pillow of claim 1 further comprising a plurality of cinctures which are wrappable around the pillow form to modify the first configuration into a plurality of additional decorative configurations.

6. The pillow of claim 1 wherein the cincture is configured as a loop.

7. The pillow of claim 1 wherein the cincture is constructed from elastic materials.

8. The pillow of claim 1 wherein the cincture is constructed from inelastic materials.

9. The pillow of claim 1 further comprising decorative means attached to said cincture head.

10. A decorative pillow comprising:

a pillow form resiliently deformable from a first configuration to a second configuration; and a cincture for girding and pillow having a head disposed proximate a first end and a loop adapted to receive said head form proximate a second end, said cincture having a length such that, when said cincture is wrapped around at least a portion of said form in its first configuration and said first and second ends of the cincture are jointed together by engagement of said loop of said head, said form is modified to the second configuration; and an inelastic casing adapted to enclose said cincture along its length such that when the cincture is wrapped around at least a portion of the pillow form and the first and second ends joined together, the casing will fold and pleat upon itself along the length of the cincture, thereby giving the appearance of a ruffle girding the pillow form.

11. A decorative pillow comprising:

a pillow form resiliently deformable from a first configuration to a second configuration;

a cincture for girding said pillow having a head disposed proximate a first end and a loop adapted to receive said head form proximate a second end, said cincture having a length such that, when said cincture is wrapped around at least a portion of said form in its first configuration and said first and second ends of the cincture are joined together by engagement of said loop with said head, said form is modified to the second configuration; and an inelastic casing adapted to enclose at least a portion of said cincture along its length such that when the cincture is wrapped around at least a portion of the pillow form and the first and second ends joined together, the casing may be crumpled and arranged to simulate the appearance of a decorative motif girding the pillow form.

12. A decorative pillow comprising:

a pillow form resiliently deformable from a first configuration to a second configuration;

a cincture for girding said pillow having a head disposed proximate a first end and a loop adapted to receive said head formed proximate a second end, said head formed proximate a second end, said cincture having a length such that, when said cincture is wrapped around at least a portion of said form in its first configuration and said first and second ends of the cincture are joined together by engagement of said loop with said head, said form is modified to the second configuration; and an ornamental body having an aperture therethrough such that the cincture may be threaded through the aperture, thereby securing the ornamental body to the pillow form when the cincture is wrapped around at least a portion of the pillow form and the first and second ends joined together.

13. A decorative pillow comprising:

a pillow form resiliently deformable from a first configuration to a second configuration;

a first pillow cover configured to cover and contain said pillow form;

a second pillow cover configured to contain and cover a portion of said pillow form and said first pillow cover;

a cincture for girding said pillow form having a head disposed proximate a first end and a loop adapted to receive said head formed proximate a second end, said cincture having a length such that, when said cincture is wrapped around at least a portion of said form in its first configuration and said first and second ends of the cincture are joined together by engagement of said loop with said head, said form is modified to the second configuration.

14. The pillow of claim 13 wherein the second pillow cover has a different appearance than the first pillow cover.

15. The pillow cover of claim 14 wherein said second cover terminates in a free edge portion, said edge portion adapted to be tucked under said cincture along the length thereof, thereby covering the cincture.

16. A decorative pillow comprising:

a pillow form resiliently deformable from a first configuration to a second decorative configuration;

a cincture for girding said pillow having a length such that, when said cincture is wrapped around at least a portion of said pillow form in its first configuration, said form is modified to its second decorative configuration; and an inelastic casing separate from said pillow form, said casing adapted to enclose said cincture along its length such that when the cincture is wrapped around the pillow form, the casing may be arranged to further enhance the decorative qualities of said pillow.

17. The pillow of claim 16 further comprising a first pillow cover configured to cover and contain said pillow form.

18. The pillow of claim 16 further comprising a plurality of cinctures which are wrappable around the pillow form to modify the first configuration into a plurality of additional decorative configurations.

19. The pillow of claim 16 wherein the cincture is configured as a loop.

20. The pillow of claim 16 wherein the cincture is constructed from elastic materials.

21. The pillow of claim 16 wherein the cincture is constructed from inelastic materials.

22. A decorative pillow comprising:

a pillow form resiliently deformable from a first configuration to a second configuration;

a first pillow cover configured to cover and contain said pillow form;

a second pillow cover configured to contain and cover a portion of said pillow form and said first pillow cover;

a cincture for girding said pillow form having a head disposed proximate a first end and a loop constructed from elastic materials adapted to receive said head formed proximate a second end, said cincture having a length such that, when said cincture is wrapped around at least a portion of said pillow form in its first configuration, and said first and second ends of the cincture are joined together by engagement of said loop with said head, said form is modified to its second configuration; and an inelastic casing adapted to enclose said cincture along its length such that when the cincture is wrapped around the pillow form, the casing may be arranged to further enhance the decorative qualities of said pillow.

23. The pillow of claim 22 wherein the second pillow cover has a different appearance than the first pillow cover.

* * * * *